US007134469B2

(12) United States Patent
Drew et al.

(10) Patent No.: US 7,134,469 B2
(45) Date of Patent: Nov. 14, 2006

(54) HEADRAIL MOUNTING SYSTEM

(75) Inventors: Terrence M. Drew, Superior, CO (US); Stephen P. Smith, Denver, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 262 days.

(21) Appl. No.: 10/848,393

(22) Filed: May 17, 2004

(65) Prior Publication Data

US 2005/0252614 A1 Nov. 17, 2005

(51) Int. Cl.
*E06B 9/00* (2006.01)
*E06B 9/17* (2006.01)

(52) U.S. Cl. ..... 160/38; 160/902; 248/273; 248/267

(58) Field of Classification Search ..... 160/19, 160/38, 902; 248/267, 262, 273, 254; D6/575
See application file for complete search history.

(56) References Cited

U.S. PATENT DOCUMENTS 4,949,926 A * 8/1990 Liu ..... 248/251
5,074,350 A * 12/1991 Carter ..... 160/178.1 R
5,131,616 A * 7/1992 Biba ..... 248/265
5,180,130 A * 1/1993 McMichael ..... 248/251
5,195,570 A * 3/1993 Marocco ..... 160/178.1 R
5,533,560 A * 7/1996 Morris ..... 160/178.1 R
6,186,457 B1 * 2/2001 Carter ..... 248/251
6,360,806 B1 * 3/2002 Bowman et al. ..... 160/168.1 V
6,540,187 B1 * 4/2003 Carter ..... 248/251
6,561,475 B1 * 5/2003 Chuang ..... 248/264

* cited by examiner

*Primary Examiner*—Hugh B. Thompson, II
*Assistant Examiner*—Candace L. Bradford
(74) *Attorney, Agent, or Firm*—Dorsey & Whitney LLP

(57) ABSTRACT

A system for mounting a covering for an architectural opening in the architectural opening includes a bracket in which an edge of the headrail for the covering can be inserted and a releasable locking system operative with a slide member to securely lock the headrail to the bracket in one position and allow the headrail to be easily removed from the bracket in a different position of the slide.

12 Claims, 7 Drawing Sheets

HEADRAIL MOUNTING SYSTEM

BACKGROUND OF THE INVENTION

1. Field of the Invention

The present invention relates generally to coverings for architectural openings such as window shades, window blinds and the like, and more particularly to a system for mounting the headrail of such a covering in the frame of an architectural opening.

2. Description of the Relevant Art

Coverings for architectural openings include products such as venetian blinds, retractable roller shades, collapsible shades, and the like. Such coverings typically include a headrail in which the remainder of the covering can be confined in a retracted position of the covering. The headrail is typically mounted to the framework of an architectural opening such as a window, door, archway, or the like and brackets are typically secured to the framework which are releasably connectable to the headrail to facilitate mounting and removal of the headrail. Systems are normally employed for releasably attaching the headrail to the brackets so that the headrail is not inadvertently released from the brackets, but so the headrail can be relatively easily removed from the brackets for cleaning purposes or the like.

Considerable thought is given to such systems for mounting coverings for architectural openings and it is to further the development of that art that the present invention has been made.

BRIEF SUMMARY OF THE INVENTION

The present invention relates to a system for mounting a covering in an architectural opening wherein the system includes a headrail from which a depending material structure is suspended. Brackets are provided that can be connected to the framework surrounding the architectural opening to releasably mount the headrail in the opening.

The brackets include a structure for releasably receiving a lip on the headrail. The structure has a flexible latch arm that cooperates with the lip and a manually movable slide operative to permit or prevent flexing of the latch arm to correspondingly permit or prevent removal of the headrail from its connection with the mounting bracket. One or more mounting brackets can be utilized depending upon the width of the covering.

Other aspects, features, and details of the present invention can be more completely understood by reference to the following detailed description of a preferred embodiment, taken in conjunction with the drawings and from the appended claims.

DETAILED DESCRIPTION OF THE INVENTION

Figure 1:
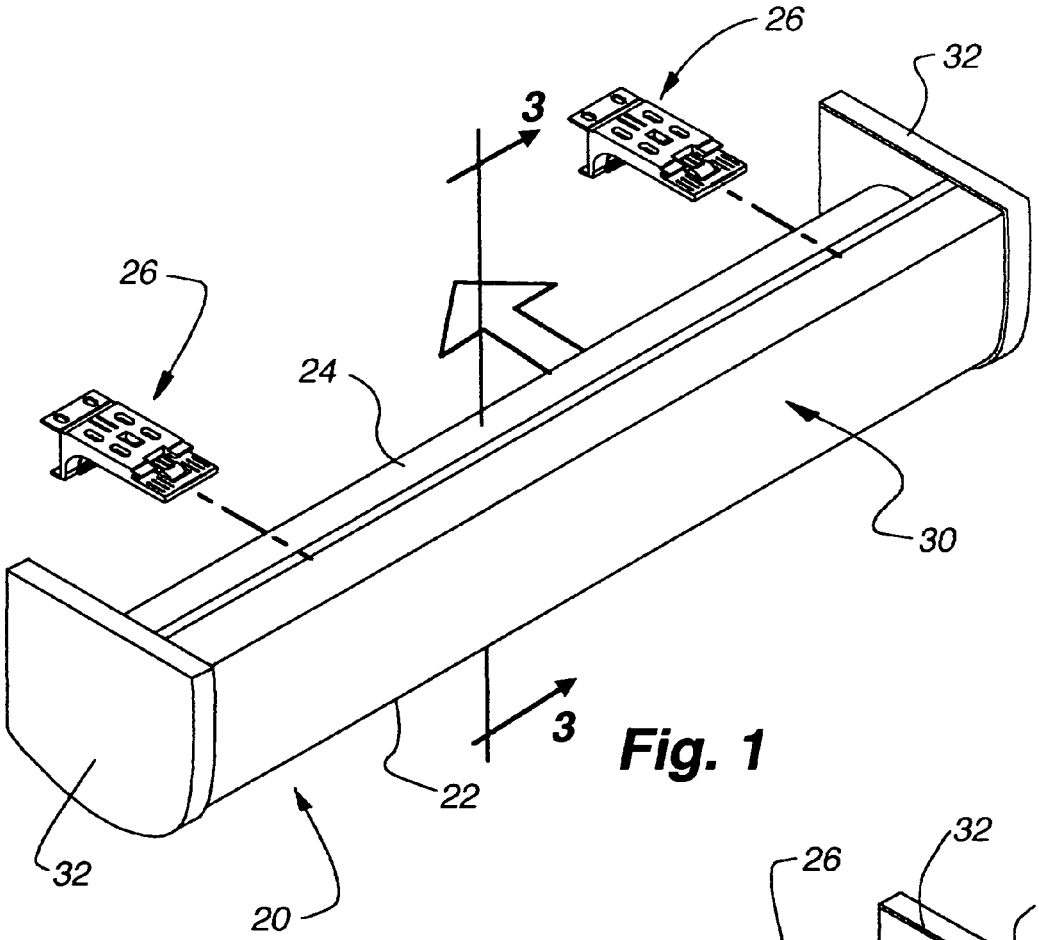
FIG. 1 is an exploded isometric looking at the front of the headrail of a covering for an architectural opening in alignment with a pair of mounting brackets in accordance with the present invention.
Figure 2:
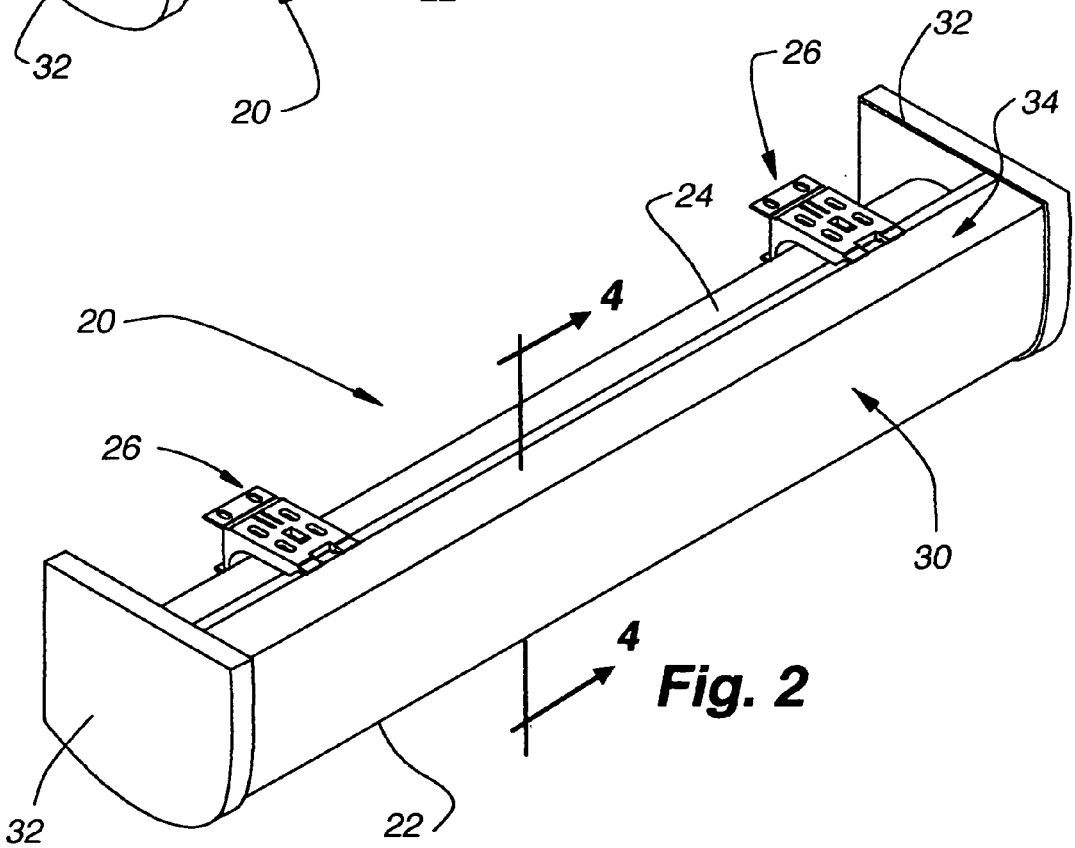
FIG. 2 is an isometric similar to FIG. 1 with the headrail mounted on the brackets.
Figure 3:
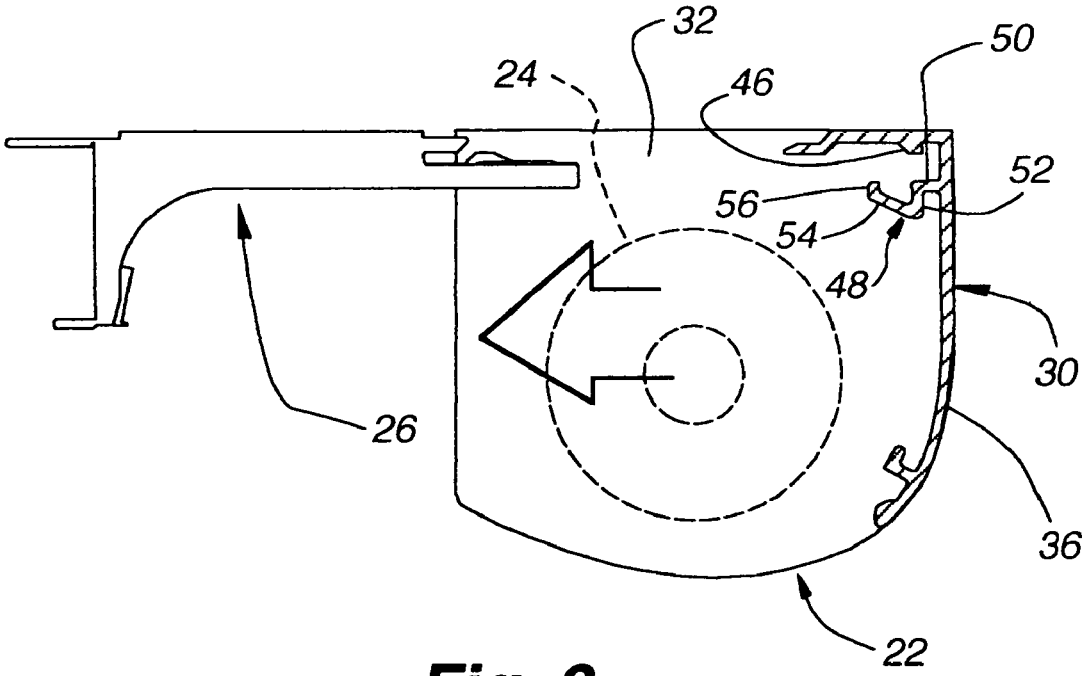
FIG. 3 is an enlarged section taken along line 3—3 of FIG. 1.
Figure 4:
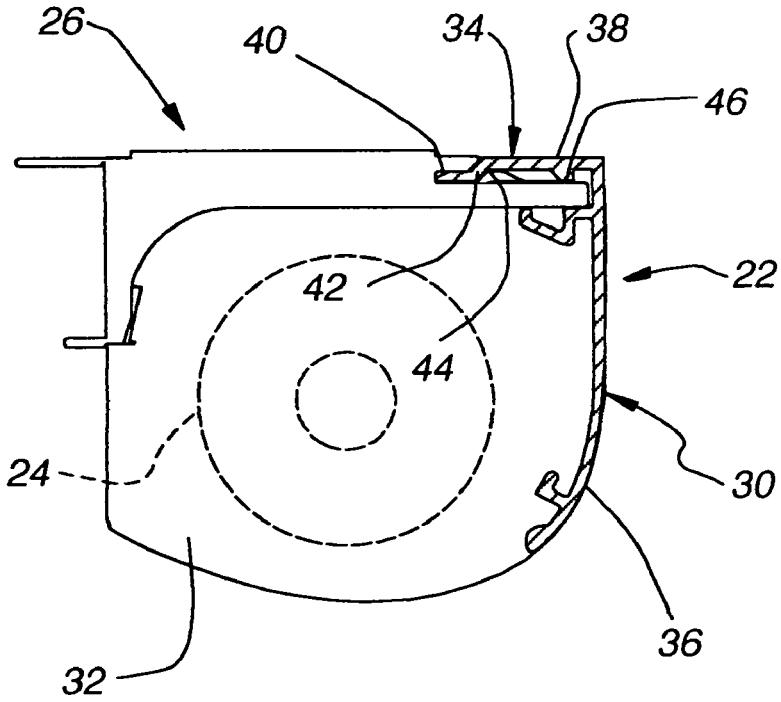
FIG. 4 is an enlarged section taken along line 4—4 of FIG. 2.

Referring first to FIG. 1, a covering 20 for an architectural opening in accordance with the present invention includes a headrail 22 which supports a roller-type panel of material 24 which is shown fully retracted in FIG. 1. Since the type of material used in the covering is of no relevance to the present invention, it will not be described in more detail, it being understood that the panel could be a sheet of material, a venetian blind product, a collapsible shade product, or numerous other similar products. Suffice it to say the panel of material 24 may be retractable into the headrail when the covering is in a retracted position such as illustrated in the drawings of the present invention.

In FIG. 1, the headrail 22 is shown aligned with a pair of identical mounting brackets 26 which are adapted to be secured in the framework 28 (FIG. 12) of an architectural opening in a manner to be described hereafter and releasably connected to the headrail in supporting relationship therewith so the headrail is not inadvertently displaced from the brackets but can be selectively released from the brackets in a convenient manner.

The headrail 22, as is probably best seen in FIGS. 1–6, includes a front plate 30 and a pair of end caps 32 on which a roll of the panel of material 24 is rotatably mounted. The front plate is secured to the end caps in any suitable manner such as a snap or friction fit with fasteners or the like. The front plate includes a top component or lip 34 which protrudes perpendicularly rearwardly and generally horizontally from a front component 36. The front component 36 is generally planar but curved inwardly adjacent to its bottom edge to better conceal the roll of panel material 24. The front plate 30 could be made in different ways but preferably is extruded from a rigid material such as aluminum or plastic.

The lip 34 has a flat outer portion 38 and a flat inner portion 40 of smaller dimension that is displaced downwardly by an inclined connecting ramp 42. The inclined connecting ramp defines an abutment surface 44 on its underside which faces outwardly and cooperates with the mounting bracket 26 in a manner to be described later. A longitudinally extending bead 46 also protrudes from the undersurface of the outer portion 38 in slightly spaced relationship from the front component 36. A support ledge 48 also protrudes rearwardly from the front component and extends longitudinally thereof in a generally horizontal orientation with the support ledge having an outer flat planar portion 50 continuous with a vertically downturned intermediate portion 52 that is in turn continuous with an upwardly and inwardly inclined plate portion 54 that terminates along its inner edge in an upturned rib 56. The upturned rib 56 and the outer planar portion 50 of the support ledge 48 are horizontally coplanar and are spaced vertically a predetermined distance from the bead 46 depending from the outer portion 38 of the top component or lip 34. A space or pocket is therefore defined between the bead 46 and the support ledge 48 in which a portion of the bracket 26 can be releasably received in a manner to be described hereafter.

The bracket 26 on which the headrail 22 is mounted is probably best seen in FIGS. 5–8 wherein it will be appreciated it includes a main body 58 which is horizontally disposed, a downturned leg 60 at a rear end of the main body, and a catch portion 62 at the front end of the main body which is adapted to cooperate with the headrail 22 to facilitate the desired mounting of the headrail on the bracket.

Figure 12:
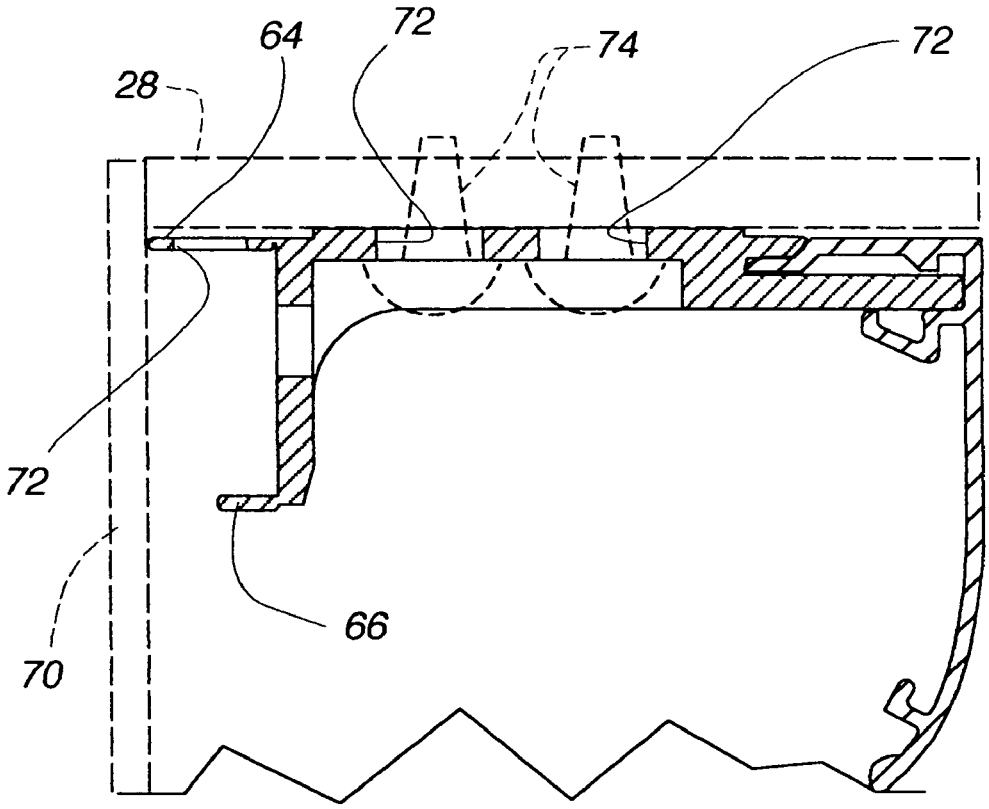
FIG. 12 is a section taken along line 12—12 of FIG. 6 with the frame of an architectural opening being shown in dashed lines.
Figure 13:
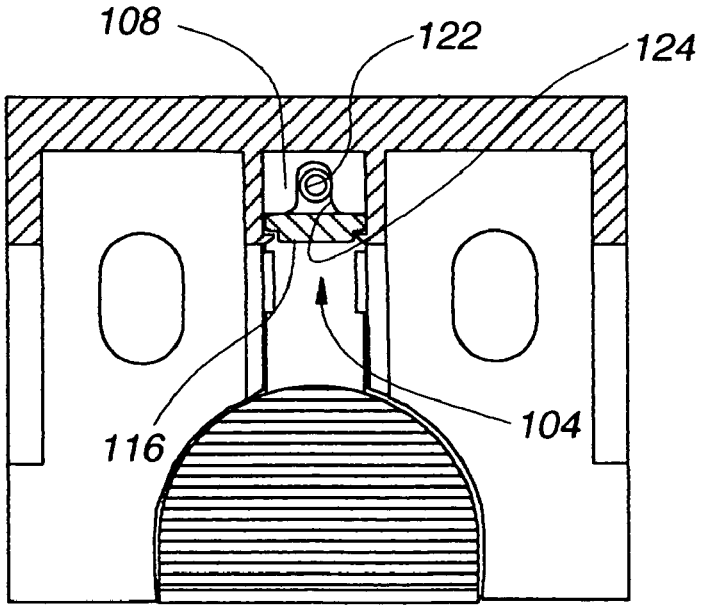
FIG. 13 is a section taken along line 13—13 of FIG. 6.

The downturned leg 60 at the rear of the bracket has a horizontally extending flange 64 of a first dimension from its top edge and a horizontally extending flange 66 from its lower edge of a second smaller dimension. Each of these flanges are connected to the downturned leg along relatively thin connection lines 68 so they can be severed or easily separated from the bracket if desired. The flanges are of predetermined dimensions or depths to facilitate uniform mounting of a plurality of brackets to the framework 28 of an architectural opening. In other words, as best seen in FIG. 12, if it were desired to mount the bracket 26 so that the main body 58 was spaced from a vertical portion 70 of the frame of an architectural opening a predetermined distance consistent with the depth of the upper flange 64, it would simply be a matter of sliding the upper flange of the bracket against the vertical portion 70 of the frame and following this procedure uniformly with each bracket so they are all spaced from the frame portion the same distance equal to the depth of the upper flange. If it were desired to mount the main portion of the bracket at a smaller spacing from the framework of the architectural opening, the upper flange 64 could be snapped off or removed from the remainder of the bracket and the lower extension 66 could then be used as a means for uniformly spacing the bracket from the framework. If no spacing at all was desired, or a spacing different from the depth of the upper or lower flanges, the lower flange 66 could also be snapped off or removed from the bracket so that the rear face of the leg 60 would abut the frame portion 70 or be spaced therefrom any desired amount.

The upper flange 64 and the main body 58 of the bracket include a plurality of ovular passages 72 through which fasteners 74 (FIG. 12) can extend to secure the bracket to the framework 28 around an architectural opening. The ovular configuration of the passages permits minor adjustments in the location of the bracket.

Figure 5:
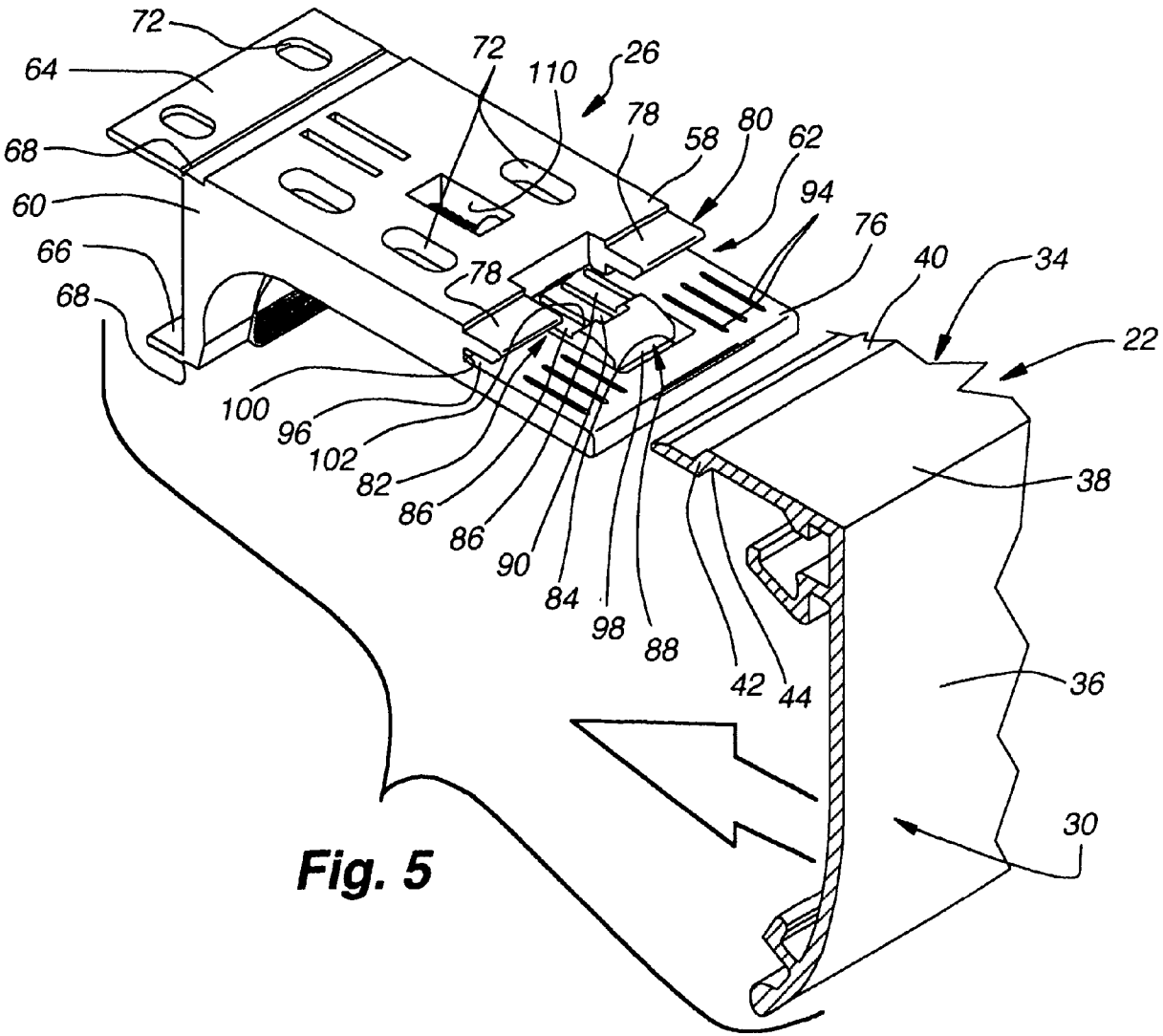
FIG. 5 is an exploded fragmentary view illustrating the alignment of the headrail with a mounting bracket prior to insertion of the headrail into the mounting bracket.
Figure 8:
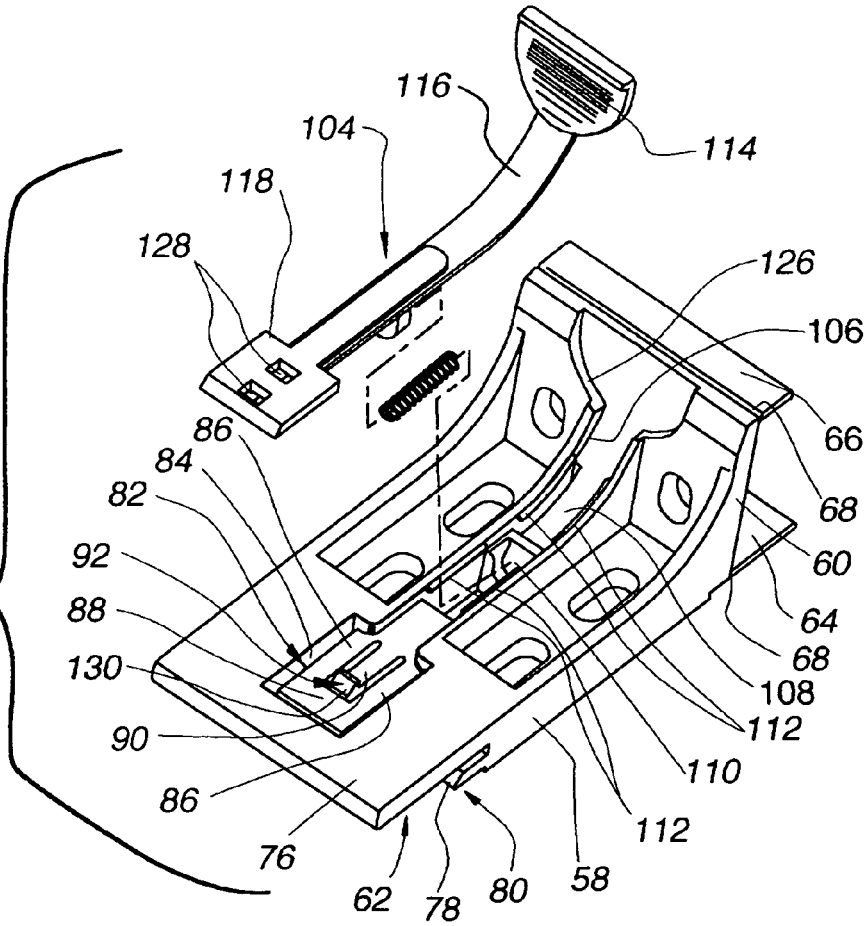
FIG. 8 is an exploded isometric similar to FIG. 7.
Figure 7:
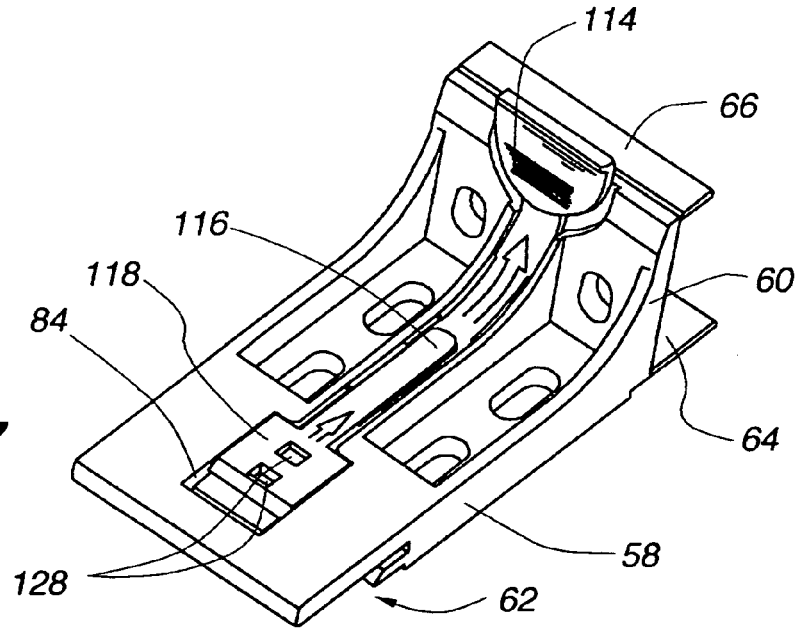
FIG. 7 is an isometric looking upwardly at the bottom of a mounting bracket.

With particular reference to FIG. 5, the front of the main body 58 as mentioned previously defines a catch portion 62 with the catch portion including a bottom plate 76, a pair of upper arms 78 which in combination define an upper plate 80 with the upper plate being spaced from the bottom plate a distance generally corresponding to the thickness of the lip 34 of the headrail 22 and a latch arm 82 disposed in a slot 84 formed in the bottom plate. It should be noted the entire bracket 26 is made of a somewhat rigid material that can be flexed slightly depending upon its localized thickness and structure. The latch arm 82 itself is flexible anchored at a rearward end thereof in the main body 58 with the opposite or front end of the latch arm being free to swing or pivot slightly up and down. The latch arm 82, as is probably best appreciated by reference to FIGS. 5 and 8, is divided into three parallel fingers with the two outer fingers 86 supporting an upwardly extending latch head 88 and the middle finger 90 supporting a downwardly extending lip 92. The middle latch finger 90 is flexible independently of the outer latch fingers 86 so the latch head 88 can flex upwardly or downwardly independent of the middle latch finger 90. The top surface of the bottom plate 76 of the catch portion has a plurality of parallel slide ribs 94 so the lip 34 of the headrail 22 can be easily slid into a catch slot 96 defined between the upper plate 80 and bottom plate 76 of the catch portion 62 of the bracket.

It will be appreciated in FIG. 5, however, that the latch head 88 on the latch arm 82 projects upwardly into the catch slot 96 so as to engage the undersurface of the lip 34 of the headrail as it is advanced into the catch slot. The forward top surface 98 of the latch head is beveled upwardly and rearwardly, however, so that as the lip of the headrail engages the latch head, the latch head is forced to flex downwardly out of the catch slot so that the lip is free to slide completely into the catch slot and abut the rearward terminal end 100 of the catch slot. With the lip abutting the rearward end 100 of the catch slot, the latch head protrudes beyond the abutment surface 44 on the lip and due to the resiliency of the somewhat rigid but flexible material from which the bracket is made, the latch arm 82 will flex or snap upwardly so the latch head is positioned forwardly of the abutment surface and in engagement therewith to releasably secure the lip of the headrail in the catch slot. The rear surface 102 of the latch head is beveled complementary to the abutment surface 44 so these two surfaces mate with each other when the lip 34 is fully inserted in the catch slot. If the lip of the headrail is pulled perpendicularly away from the bracket 26, the inclined abutment surface 44 and beveled rear surface 102 of the latch head urge the latch head to pivot downwardly out of the catch slot permitting the lip of the headrail to be slid out of the catch slot for removal of the headrail from the bracket.

To prevent an inadvertent removal of the headrail 22 from the bracket 26, the bracket has been designed with a slide ribbon 104 that selectively permits or prevents downward flexing movement of the latch arm 82 on which the latch head 88 is formed. Accordingly, as will be described hereafter, movement of the slide ribbon between a first position and a second position, respectively, prevents or permits the pivotal movement of the latch head which in turn prevents or permits removal of the headrail from the bracket.

With reference to FIG. 8, it will be appreciated the undersurface of the main body 58 of the bracket 26 is provided with a longitudinally extending curved recess 106 in which the slide ribbon 104 is slidably positioned. The recess extends from the lower edge of the downturned leg 60 along an arcuate path defined by a vertical rib 108 of the bracket and across a rectangular passage or hole 110 formed in the main body. The groove then extends forwardly until it connects with the slot 84 through the bottom plate 76 at the catch portion 62 of the bracket. Two pair of retention flanges 112 are provided along opposite sides of the recess 106 and in spaced relationship from the bottom of the recess with these retention flanges being designed to slidably retain the slide ribbon in the curved recess. The flexibility of the slide ribbon, however, allows it to be snapped into the recess 106 by forcing it past the retention flanges 112 during assembly of the bracket.

The slide ribbon 104 can be made of the same material as the main body which is somewhat rigid but flexible so it can flexibly conform with the curved recess and slide within the recess. The slide ribbon has a finger tab 114 at its rearward end which is connected through an elongated main body 116 to an enlarged catch head 118 at the forward end of the slide ribbon. A cylindrical spring seat 120 is mounted on the main body 116 of the slide ribbon so as to project upwardly, as probably best seen in FIGS. 9–11, with the spring seat defining a circular rearwardly directed recess adapted to receive one end of a compression spring 122. The opposite end of the compression spring is seated in a saddle 124 defined at the rear end of the rectangular passage 110 through the main body. The spring of course is retained in position within the saddle and the spring seat once the slide ribbon has been positioned within the curved recess 106 provided in the undersurface of the main body 58 and retained therein by the retention flanges 112.

The compression spring 122 is adapted to bias the slide ribbon 104 forwardly into a first position wherein the finger tab 114 is fully seated within an enlarged portion 126 of the curved recess along the downturned leg 60. In this same position, as possibly best appreciated by reference to FIG. 9, the catch head 118 fully underlies the forward end of the latch arm 82 directly beneath the latch head 88. The slide ribbon is slidably movable within the curved recess in a rearward direction by engaging the finger tab and pulling it downwardly against the bias of the compression spring. Movement of the ribbon in this direction slides the catch head 118 rearwardly to the position of FIG. 10 wherein it only partially underlies the latch head 88 but more importantly is operatively removed from vertical overlying alignment with the support ledge 48 in the headrail as will be described in more detail hereafter. Accordingly, the slide ribbon is movable between two positions in its operation, and as will be appreciated by reference to FIG. 8, the catch head 118 has a pair of longitudinally spaced rectangular detents in the form of openings 128 therethrough which are sized to receive and cooperate with the downturned lip 92 on the middle latch finger 90 of the latch arm 82. The lip 92 on the middle latch finger is therefore adapted to be releasably inserted into one or the other of the openings 128 in the catch head to releasably retain the slide ribbon in either its first or second position. In the first position, the lip on the middle latch finger is inserted into the rearmost one of the two rectangular openings but as appreciated in FIG. 8, the front surface 130 of the lip 92 is beveled upwardly and rearwardly so that as the slide ribbon is pulled toward the second position, the middle latch finger 90 is flexed and forced upwardly until it overlies the forwardmost opening in the catch head and snaps downwardly into that position. It should be remembered, however, that the compression spring 122 biases the slide ribbon toward the first position, so that when the lip 92 is removed from the forwardmost opening in the catch head, the slide ribbon is abruptly forced forwardly to its first position allowing the lip 92 to again become aligned with the rearwardmost opening and snapped back into that opening.

Figure 6:
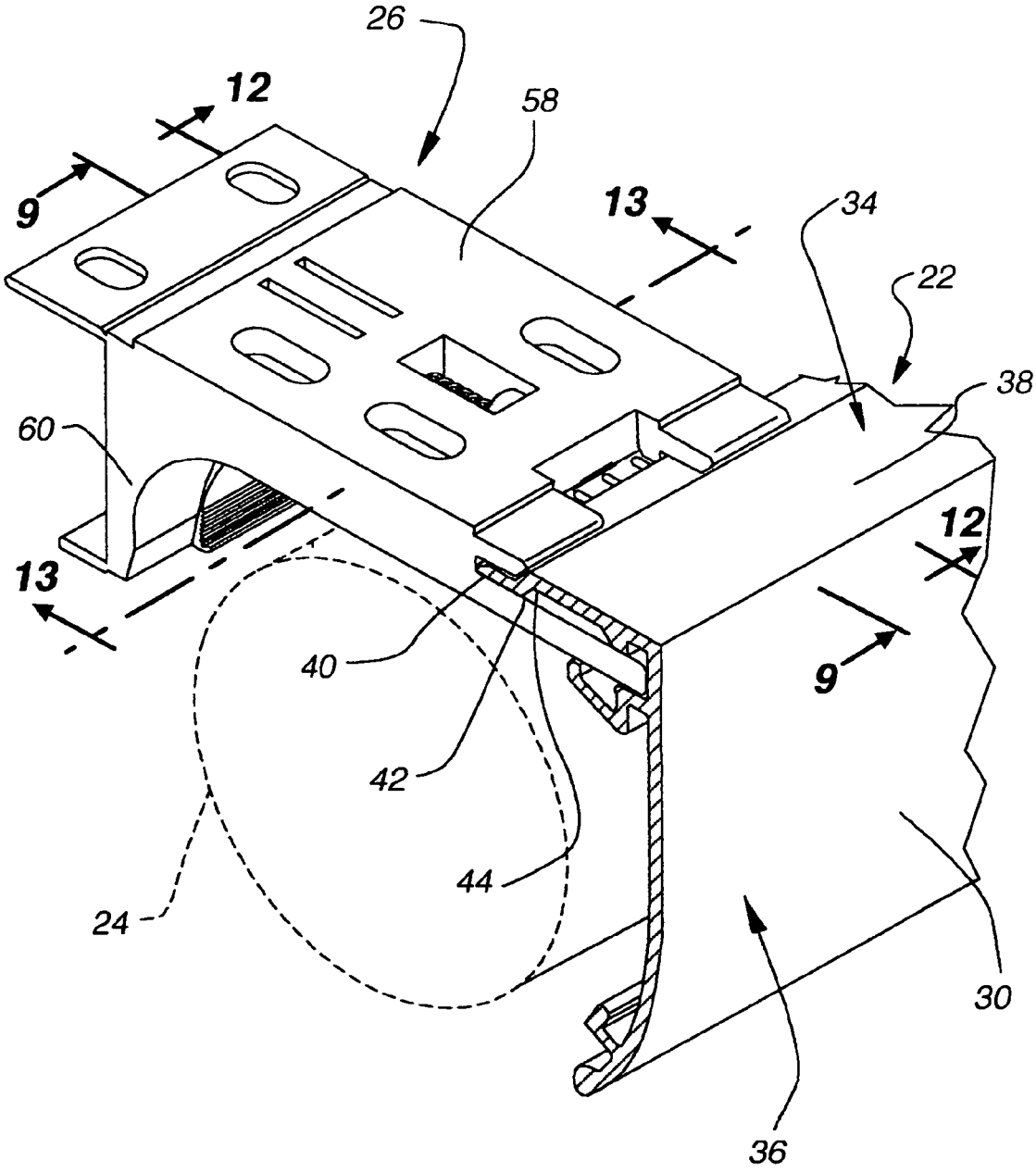
FIG. 6 is an isometric similar to FIG. 5 with the headrail having been inserted into the mounting bracket.
Figure 9:
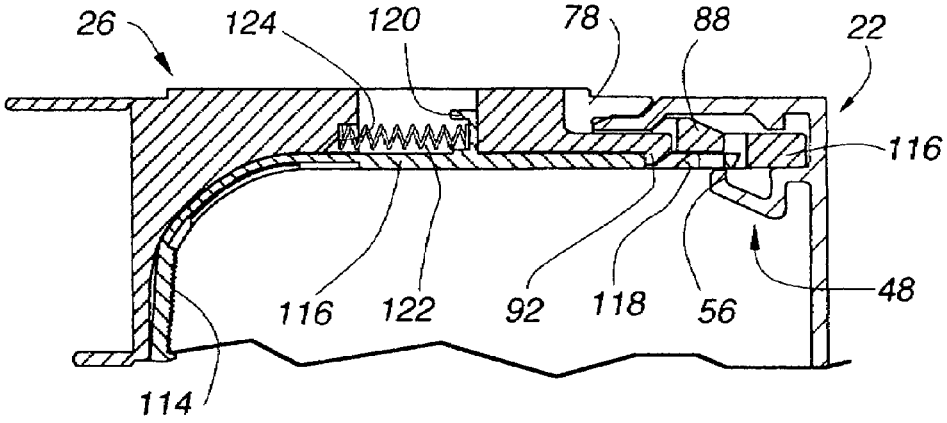
FIG. 9 is an enlarged section taken line 9—9 of FIG. 6 showing the headrail releasably connected to a mounting bracket.

The operation of the connection of the headrail 22 to a mounting bracket 26 is best appreciated by reference to FIGS. 5, 6, and 9–11. Commencing with the separated relationship of the headrail from the bracket as shown in FIG. 5, the headrail is moved rearwardly in the direction of the arrow allowing the beveled inner edge of the lip 34 on the headrail to slide over the bottom plate 76, engage the latch head 88 to force it to pivot downwardly and subsequently out of the space between the upper 80 and lower 76 plates of the catch portion 62 of the bracket. When fully inserted into this relationship as seen in FIGS. 6 and 9, the latch head 88 is allowed to snap upwardly to engage the abutment surface 44 on the underside of the lip of the headrail, and the bottom plate 76 is inserted fully into the space or pocket between the bead on the headrail and the support ledge 48. The bottom plate 76 is then firmly positioned between the lower protruding bead 46 and the outer flat planar portion 50 of the support ledge with the innermost rib 56 of the support ledge underlying the catch head 118 of the slide ribbon 104 thereby preventing the catch head from flexing downwardly. With the catch head retained in this position, it supports the latch arm 82 thus retaining the latch head in engagement with the abutment surface 44 of the lip 34. This of course locks the headrail into the position of FIGS. 6 and 9 so as to prevent an inadvertent release of the headrail from the bracket.

Figure 10:
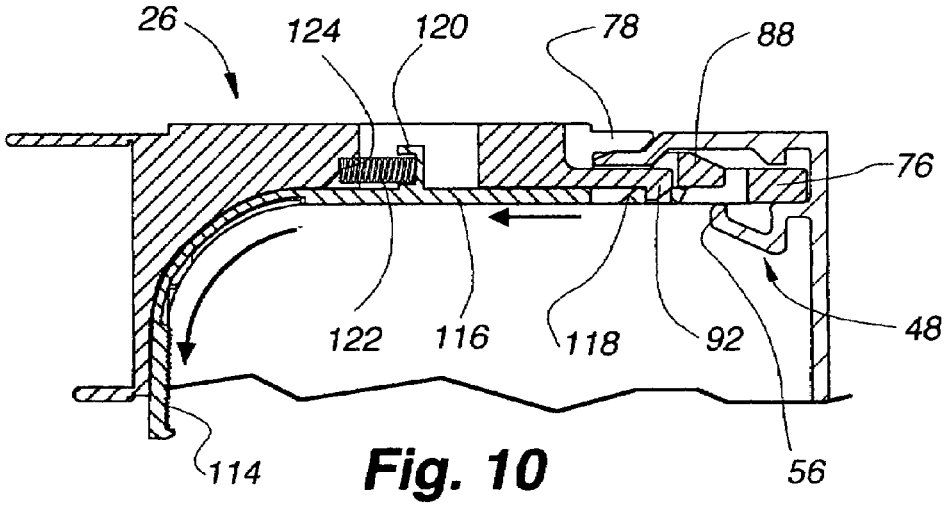
FIG. 10 is a section similar to FIG. 9 showing the slide in the bracket in a second position in which the headrail can be released from the bracket.
Figure 11:
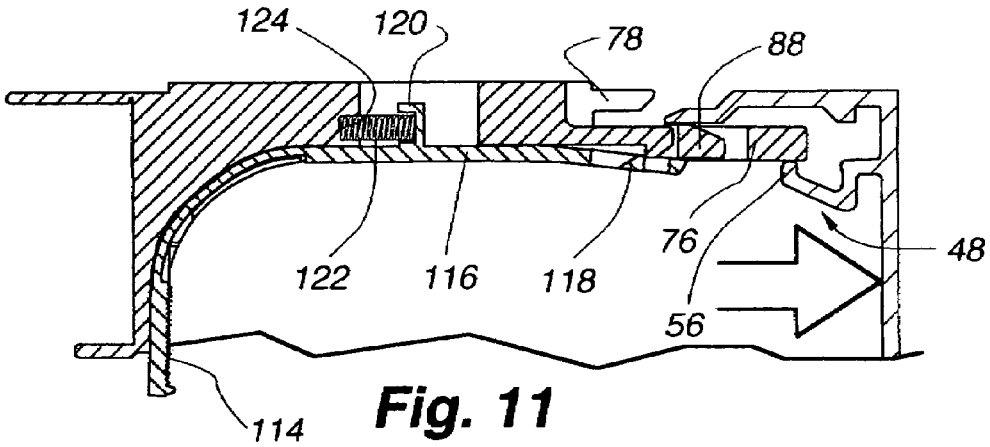
FIG. 11 is a section similar to FIGS. 9 and 10 with the slide in the second position and the headrail being slidably removed from the bracket.

To release the headrail from the bracket, the slide ribbon 104 is first moved from its first position of FIGS. 6 and 9 to its second position of FIG. 10. In doing so, the catch head 118 is slid rearwardly from its overlying relationship with the support ledge 48 and once removed from vertical alignment with the support ledge, the catch head is allowed to flex downwardly under the bias of the lip 92 on the middle latch finger 90 until the lip 92 becomes aligned with the forwardmost opening 128 in the catch head and snaps into that opening so as to retain the slide ribbon in the second or release position. The slide ribbon is then positioned so that the headrail 22 can be retracted or slid perpendicularly away from the bracket 26 and removed therefrom as illustrated in FIG. 11.

As the headrail is retracted perpendicularly away from the bracket, the inclined abutment surface 44 and the beveled rear surface 102 of the latch head force the latch head to pivot downwardly out of the path of movement of the lip 34 on the headrail so that the lip of the headrail is free to be retracted out of the catch slot 96 in the bracket. As the latch head pivots downwardly with the two outer fingers 86 leaving the middle finger 90 horizontally oriented, the latch head forces the catch head downwardly releasing the lip 92 on the middle latch finger from its engagement in the outer opening 128 in the catch head and allows the catch head under the bias of the compression spring 122 to abruptly slide forwardly so the lip can be received in and engage the rearward opening 128. Accordingly, the bracket automatically resets as the headrail is removed therefrom and is in a position to again receive the headrail in a manner as described previously.

Any number of brackets 26 can be mounted across the top of the frame 28 of an architectural opening usually dependent upon the width of the opening and accordingly the width of the covering being mounted therein. Reference to FIG. 12 illustrates how the bracket can be secured to an upper horizontal frame member around an architectural opening simply by inserting the fasteners 74 through the ovular passages 72 in the horizontal main body 58 of the bracket and securing the fasteners into the frame 28.

It will be appreciated from the above that a system for mounting a headrail in an architectural opening has been described which is easy to operate and reliable in securing the headrail to a mounted bracket in a manner to prevent inadvertent release. The system is further designed to reset once the headrail has been removed from the bracket so it is conditioned for reinsertion of the headrail into the bracket. Further, the component parts snap between different operative positions of the bracket giving the operator an audible indication of when the bracket is in a release mode or a locking mode which further facilitates easy operation of the system.

Although the present invention has been described with a certain degree of particularity, it is understood the disclosure has been made by way of example and changes in detail or structure may be made without departing from the spirit of the invention as defined in the appended claims.

What is claimed is:

1. A mounting system for a covering for an architectural opening comprising in combination: a headrail having a covering mounted therein and a protruding lip; and a mounting bracket including a catch slot for releasably receiving said lip, a resilient latch arm in said catch slot for releasable connection to said lip, a slide including a catch head overlying said latch arm, said slide being slidably movable between first and second positions, said catch head in said first position locking the latch arm in secured relationship to the lip in the catch slot and in the second position allowing the latch arm to release the lip from said catch slot.

2. A mounting system for a covering for an architectural opening comprising in combination:

a head rail having a covering mounted thereon and a protruding lip; and a mounting bracket including a catch slot for releasably receiving said lip, a resilient latch arm in said catch slot for releasable connection to said lip, a slide including a catch head operatively associated with said latch arm, said slide movable between first and second positions, said catch head in said first position forcing the latch arm to secure the lip in the catch slot and in the second position allowing the latch arm to release the lip from the catch slot, and further wherein said latch arm includes a latch finger and said catch head includes detent means for releasable connection to said latch finger in said first and second positions of said slide for releasably securing said catch head to said latch arm in said first and second positions.

3. The system of claim 2 wherein said slide and said latch arm are somewhat rigid but flexible.

4. The system of claim 3 wherein said headrail further includes a support ledge spaced from said lip to define a space therebetween, said space adapted to receive a portion of said bracket when the headrail is mounted on said bracket.

5. The system of claim 4 wherein said support ledge prohibits flexing movement of said catch head when said slide is in said first position and permits flexing movement of said catch head in said second position.

6. The system of claim 5 wherein said headrail further includes an abutment surface, said bracket further includes a latch head on said latch arm, said latch head adapted to engage said abutment surface in a locking position of said latch head when the headrail is mounted on said bracket to releasably secure the headrail to the bracket.

7. The system of claim 6 wherein said latch head is movable to a release position upon flexing movement of said latch arm, said lip being slidably movable out of said catch slot when said latch head is in said release position.

8. The system of claim 7 wherein said catch head prohibits movement of said latch head from said locking position to said release position when said slide is in said first position.

9. The system of claim 8 wherein said catch head permits movement of said latch head from said locking position to said release position when said slide is in said second position.

10. A mounting system for a covering for an architectural opening comprising in combination: a headrail having a covering mounted therein, a generally horizontally protruding lip, a generally horizontally protruding support ledge beneath said lip so as to define a space therebetween, said lip having an abutment surface, and a mounting bracket having a catch slot for releasably receiving said lip, said catch slot being defined between an upper plate and a lower plate, said lower plate being insertable into said space to mount the headrail on said bracket, a flexible latch arm having a latch head engageable with said abutment surface to releasably secure said lower plate in said space, said latch arm being flexible downwardly to release said latch head from engagement with said abutment surface, a flexible slide having a catch head underlying said latch arm, said slide being movable between a first position in which the catch head overlies said support ledge to prevent the catch head from flexing downwardly and a second position in non-vertical alignment with said support ledge so as to be flexible downwardly, said catch head in said first position maintaining said latch head in engagement with said abutment surface and in said second position permitting the latch arm to flex downwardly releasing the latch head from engagement with said abutment surface to permit the lip to be slid out of said catch slot.

11. The system of claim 10 further including selective operative detent means on said latch arm and catch head to releasably secure said catch head in said first or second position of said slide.

12. The system of claim 11 further including biasing means for biasing said slide toward said first position.

* * * * *